US005448122A

United States Patent [19]

Shiroyama et al.

[11] Patent Number: 5,448,122

[45] Date of Patent: Sep. 5, 1995

[54] BRUSH DEVICE

[75] Inventors: Shigeru Shiroyama; Akira Kuragaki, both of Hyogo, Japan

[73] Assignee: Mitsubishi Denki Kabushiki Kaisha, Tokyo, Japan

[21] Appl. No.: 229,667

[22] Filed: Apr. 19, 1994

[30] Foreign Application Priority Data

Apr. 19, 1993 [JP] Japan ..... 5-091416

[51] Int. Cl.[6] ..... H01R 39/40

[52] U.S. Cl. ..... 310/247; 310/248

[58] Field of Search ..... 310/247, 242, 245, 240, 310/239, 249, 248

[56] References Cited

U.S. PATENT DOCUMENTS

| | | | |
|---|---|---|---|
| 2,549,871 | 4/1951 | White | 310/247 |
| 3,729,639 | 4/1973 | Heinouchi et al. | 310/311 U X |
| 3,955,113 | 5/1976 | Hillyer et al. | 310/239 |
| 4,891,539 | 1/1990 | Okamoto et al. | 310/239 |
| 5,019,741 | 5/1991 | Fukui et al. | 310/239 |
| 5,332,940 | 7/1994 | Kuragaki et al. . | |

FOREIGN PATENT DOCUMENTS

| | | | |
|---|---|---|---|
| 0389767 | 3/1933 | United Kingdom | 310/247 |
| 0774616 | 5/1957 | United Kingdom | 310/247 |

*Primary Examiner*—R. Skudy

*Attorney, Agent, or Firm*—Sughrue, Mion, Zinn, Macpeak & Seas

[57] ABSTRACT

A brush device includes elliptic compression coil springs, an electrical conductive member, rotary shaft, and brushes pushed against an electrical conductive member on the rotary shaft with the elliptic compression coil springs. And the outer end parts of each of the elliptic compression coil springs are bent inwardly of the ellipse formed by the elliptic compression coil spring.

2 Claims, 3 Drawing Sheets

BRUSH DEVICE

BACKGROUND OF THE INVENTION

This invention relates to the coil springs of a brush device, and more particularly to an improvement of brush pushing compression coil springs used for electric rotary machines.

FIGS. 6 and 7 are a front view and a side view, respectively, showing a compression coil spring employed in a conventional brush device of a starter motor. FIGS. 8 and 9 are sectional views showing a brush accommodating member in which a brush is set being pushed by a compression coil spring. In those figures, reference numeral 1 designates an elliptic compression coil spring made of a steel wire. Both end portions of the spring 1 are closely coiled as indicated at 1*a* when compared with the remaining middle portion. The outer end part of one of the two closely coiled end portions 1*a* is coiled elliptic as indicated at 1*b* (hereinafter referred to as "a coiling start end part 1*b*", when applicable), and similarly the outer end part of the other is coiled elliptic as indicated at 1*c* (hereinafter referred to as "a coiling finish end part 1*c*", when applicable).

Further in FIGS. 6 through 9, reference numeral 2 designates a brush pushed by the compression coil spring 1. The brush, as shown in FIG. 9, has a rectangular abutting surface 2*a* against which the compression coil spring 1 is abutted. Reference numeral 3 designates the lead wire of the brush 2; and 4, a brush holding frame having an accommodating section 4*a*, in which the compression coil spring 1 and the brush 2 are held.

Reference numeral 5 designates an insulating board covering the opening of the accommodating section 4*a* of the brush holding frame 4. The insulating board 5 is formed by molding synthetic resin.

The conventional brush device constructed as described above, is assembled as follows: First, the brush 2 and the compression coil spring 1 are set in the accommodating section 4*a* of the brush holding frame 4, and then the opening of the accommodating section 4a is covered with the insulating board 5.

The above-described conventional brush device has following problems: If the brush device is limited in diametrical dimension, the brush length is maintained unchanged, then the compression length of the compression coil spring is limited. Hence, in this case, it is difficult to sufficiently provide closely coil both end portions of the compression coil spring 1, as a result of which the brush 2 and the elliptic compression coil spring 1 are not snugly abutted against each other, and therefore sometimes the brush 2 may be cracked. On the other hand, sometimes the end of the compression coil spring 1 may stick out over the abutting surface 2*a* of the brush 2 because of the variations in dimension of the elliptic compression coil spring 1 when manufactured. Moreover, when a number of elliptic compression coils springs are conveyed before assembling, they may be tangled with one another like puzzle rings. If once the elliptic compression coil springs are tangled, then it is rather difficult to untangle them.

Accordingly, an object of this invention is to eliminate the above-described difficulties accompanying a conventional brush device. More specifically, an object of the invention is to provide a brush device which is free from difficulties that the brush is cracked, and the end of the compression coil spring sticks out over the abutting surface of the brush, and the elliptic compression coil springs are entangled with one another during conveyance.

SUMMARY OF THE INVENTION

In order to attain the above mentioned object, the present invention provides a brush device comprising, elliptic compression coil springs, an electrical conductive member, rotary shaft, and brushes pushed against an electrical conductive member on the rotary shaft with the elliptic compression coil springs. And the outer end parts of each of the elliptic compression coil springs are bent inwardly of the ellipse formed by the elliptic compression coil spring.

Furthermore, in a brush device according to the present invention, the gap between the tip end of each of the outer end parts thus bent and the coil wire body of the elliptic compression coil spring with which the tip end is confronted is smaller than the wire diameter of the elliptic compression coil spring.

In the brush device according to the present invention, the contact area of the end part of each of the compression coil springs with the abutting surface of the respective brush is increased as much as the length of the bent end part of the elliptic compression coil spring. Furthermore, the bent end part will never come out of the abutting surface of the brush.

The brush device according to the present invention is further free from the difficulty that the elliptic compression coil springs are entangled with their end parts being engaged with one another when conveyed to a brush device assembling station.

DETAILED DESCRIPTION OF THE PREFERRED EMBODIMENTS

Figure 1:
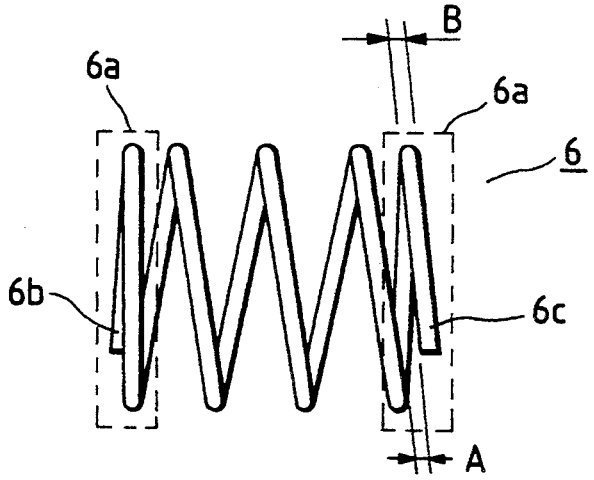
FIG. 1 is a front view of an elliptic compression coil spring in a brush device according to the invention.
Figure 2:
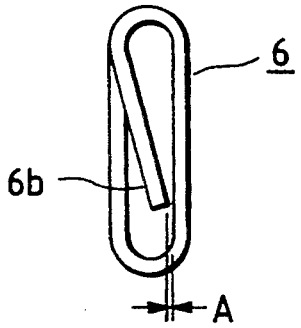
FIG. 2 is a side view of the elliptic compression coil spring shown in FIG. 1.
Figure 3:
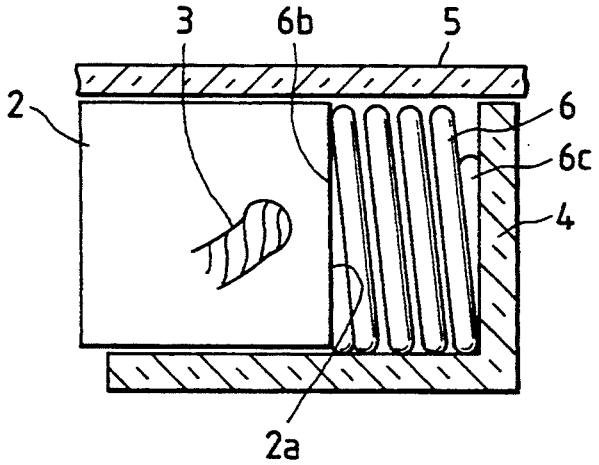
FIG. 3 is a front view, partly as a sectional view, showing the elliptic compression coil spring shown in FIG. 1, which is set in a brush holding frame.
Figure 4:
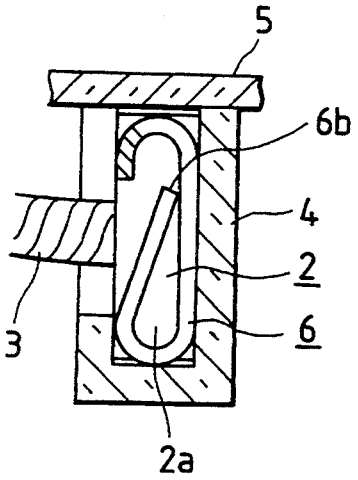
FIG. 4 is a side view, partly as a sectional view, showing the elliptic compression coil spring shown in FIG. 1, which is set in the brush holding frame.
Figure 5:
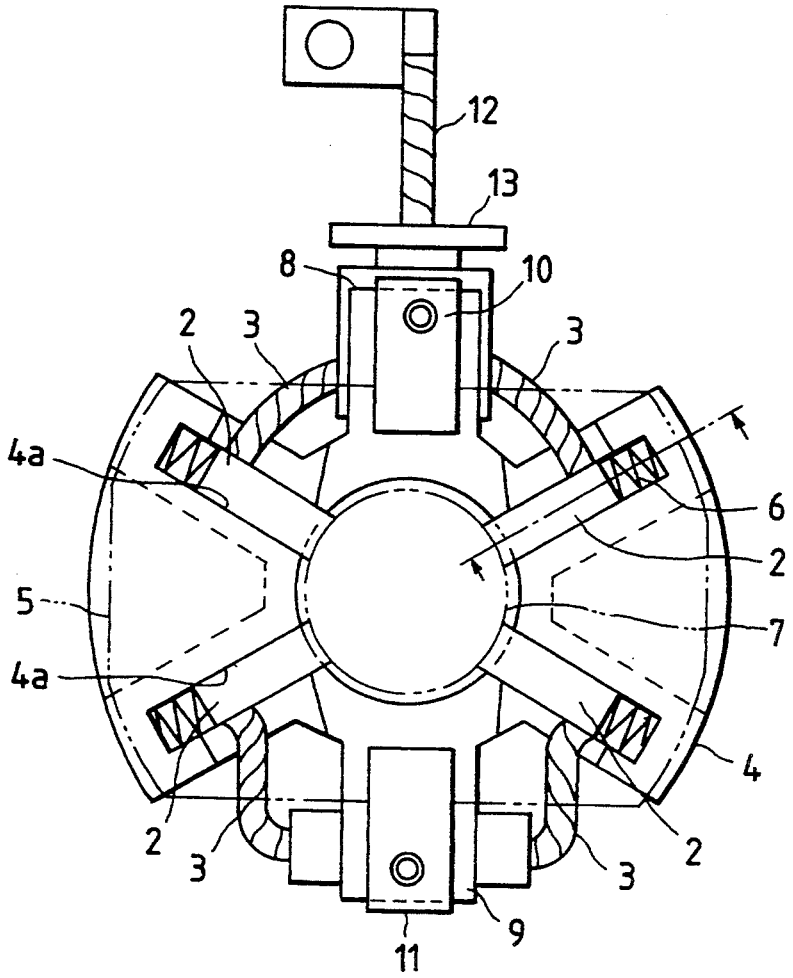
FIG. 5 is a front view showing the brush device of the invention.
Figure 6:
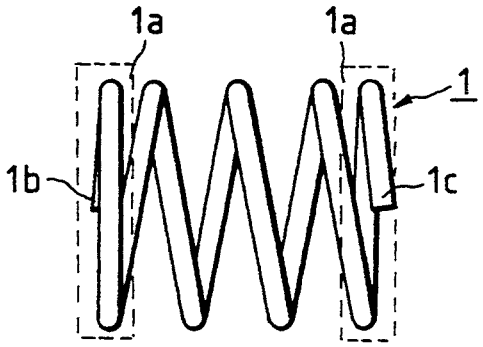
FIG. 6 (PRIOR ART)
FIG. 6 is a front view of a conventional elliptic compression coil spring.
Figure 7:
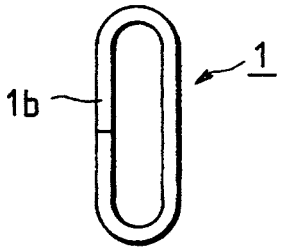
FIG. 7 (PRIOR ART)
FIG. 7 is a side view of the conventional elliptic compression coil spring shown in FIG. 6.
Figure 8:
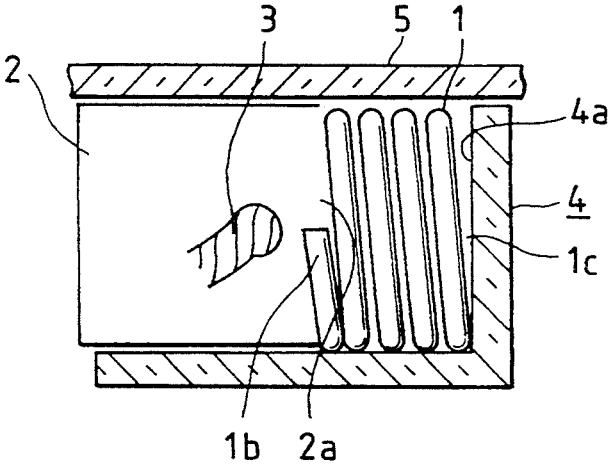
FIG. 8 (PRIOR ART)
FIG. 8 is a front view, partly as a sectional view, showing the conventional elliptic compression coil spring which is set in a brush holding frame.
Figure 9:
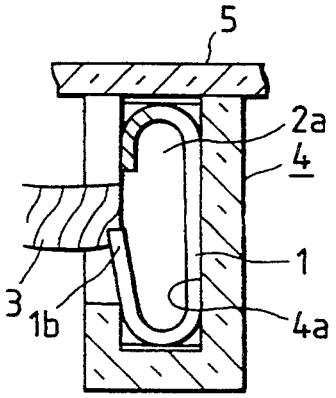
FIG. 9 (PRIOR ART)
FIG. 9 is a side view, partly as a sectional view, showing the conventional elliptic compression coil spring which is set in the brush holding frame.

A brush device according to the present invention will be described with reference to FIGS. 1 through 5.

In FIGS. 1 through 5, reference numeral 6 designates elliptic compression coil springs made of a steel wire. Both end portions of each of the compression coil springs 6 are closely coiled as indicated at 6*a* when compared with the remaining middle portion (hereinafter referred to as "closely coiled end portions 6*a*", when applicable), and the outer end parts of the closely coil end portions 6a, namely, a coiling start end part 6b and a coiling finish end part 6c are bent inwardly of the ellipse, or against itself, in such a manner that the gap A between the tip end of each of the end parts 6b and 6c thus bent and the coil wire body of the compression coil spring 6 is smaller than the wire diameter B of the compression coil spring 6.

Further in FIGS. 1 through 5, reference numeral 7 designates a commutator mounted on the rotary shaft of an electric rotary machine. Brushes 2 are slidably mounted on the commutator 7 with the aid of the above-described compression coil springs 6. Reference numerals 8 and 9 designate a pair of protrusions formed on a brush holding frame 4 in such a manner that they radially extends outwardly. Reference numerals 10 and 11 designate a pair of mounting pieces, which fixedly hold an insulating board 5 on the protrusions 8 and 9. Reference numeral 12 designates a lead wire which is attached to the lead wires 3 of the brushes 2. Reference numeral 13 designates a grommet which is connected to the lead wire 12.

In the brush device thus constructed, the brushes 2 and the compression coil springs 6 are received in the accommodating sections 4a of the brush holding frame 4, respectively. And then the openings of the accommodating sections 4a are covered with the insulating board 5. Under this condition, the mounting pieces 10 and 11 are combined with the protrusions 8 and 9 of the brush holding frame 4 to hold the insulating board 5 therebetween, the insulating board 5 is fixedly secured to the brush holding frame 4.

In the embodiment, the contact area of the elliptic compression coil spring 6 with the abutting surface of the brush 2 is increased as much as the length of the bent end part 6b of the elliptic compression coil spring 6. Furthermore, the bent end part 6b will never come out of the abutting surface of the brush 2, which prevents the brush 2 from damage such as cracking.

In the embodiment, the gap A between the tip end of each of the bent end parts 6b and 6c and the coil wire body of the compression coil spring 6 is smaller than the wire diameter B of the latter 6, and therefore the tip end of the bent end part will never go into the gap A between itself and the coil wire body of the compression coil spring 6, which eliminates the difficulty that the elliptic compression coil springs 6 are tangled with one another like puzzle rings during conveyance.

In the above-described embodiment, the accommodating sections for accommodating the brushes and the compression coil springs are formed as one unit by molding resin, and the openings of the accommodating sections are covered with the insulating board of resin; however, the invention is not limited thereto or thereby. That is, the accommodating sections may be modified in various manners for the same effect. For instance, the accommodating sections may be so formed that they are separated from one another.

The invention has been described with reference to the starter motor brush device; however, the invention is not limited thereto or thereby. That is, the technical concept of the invention may be applied to other commutator-operated motors or generators with brushes with the same effects.

In the brush device according to the invention, the outer end parts of each of the elliptic compression coil springs are bent inwardly of the ellipse formed by the elliptic compression coil spring, and therefore the contact area of each elliptic compression coil spring with the abutting surface of the respective brush is increased, which eliminates the difficulties that the brush is cracked, and the bent end part of the spring comes out of the abutting surface of the brush.

Furthermore, the gap between the tip end of each of the outer end parts thus bent and the coil wire body of the elliptic compression coil spring is smaller than the wire diameter of the elliptic compression coil spring. Therefore, the brush device is free from the difficulty that the elliptic compression coil springs are entangled like puzzle rings for instance when they are conveyed to the brush device assembling station.

What is claimed is:

1. A brush device comprising:

compression coil springs having a cross section in a shape of an ellipse;

an electrical conductive member;

a rotary shaft; and brushes pushed against said electrical conductive member on said rotary shaft by said compression coil springs;

wherein outer end parts of each of said compression coil springs are bent inwardly of the ellipse.

2. A brush device as claimed in claim 1, wherein each of said compression coil springs is formed from a coil wire having a wire diameter, and wherein each of said outer end parts has a tip end forming a gap with a nearest surface of said coil wire, such that the gap is smaller than the wire diameter.

* * * * *